US010741027B2

(12) United States Patent
Lee

(10) Patent No.: US 10,741,027 B2
(45) Date of Patent: Aug. 11, 2020

(54) ELECTRONIC GAME

(71) Applicant: Tang Dynasty Entertainment LLC, Egg Harbor Township, NJ (US)

(72) Inventor: Hui L. Lee, Egg Harbor Township, NJ (US)

(73) Assignee: TANG DYNASTY ENTERTAINMENT LLC, Egg Harbor Township, NJ (US)

( * ) Notice: Subject to any disclaimer, the term of this patent is extended or adjusted under 35 U.S.C. 154(b) by 0 days.

(21) Appl. No.: 15/700,875

(22) Filed: Sep. 11, 2017

(65) Prior Publication Data

US 2018/0075705 A1 Mar. 15, 2018

Related U.S. Application Data

(60) Provisional application No. 62/393,320, filed on Sep. 12, 2016.

(51) Int. Cl.
*G07F 17/32* (2006.01)

(52) U.S. Cl.
CPC ..... *G07F 17/3293* (2013.01); *G07F 17/3204* (2013.01)

(58) Field of Classification Search
None
See application file for complete search history.

(56) References Cited

U.S. PATENT DOCUMENTS 5,368,305 A * 11/1994 Rodda ..... A63F 3/00157 273/274
8,505,920 B1 * 8/2013 Slifker ..... G07F 17/3293 273/303

(Continued)

OTHER PUBLICATIONS

Grand Casino Brussels. "Blackjack 11's: the exciting new variant with a bonus bet". Published Jul. 13, 2016. Accessed Aug. 3, 2018. <http://www.viage.be/en/blog/blackjack-11s-exciting-new-variant-bonus-bet/>.*

(Continued)

*Primary Examiner* — Seng H Lim
(74) *Attorney, Agent, or Firm* — Stephen J. Weyer, Esq.; James R. Hayne, Esq.; Stites & Harbison, PLLC

(57) ABSTRACT

A system for playing a game includes a computer server having a processor configured to generate a plurality of random numbers, each random number being between 2 and 11 based a probably of 2 through 9 and 11 being 1 out of 13 and a probability of a 10 being 4 out of 13, each number 2 through 11 have a value corresponding to its number, respectively. The server generates at least a first random number and a second random number. A user interface is operatively associated with the computer server. The user interface has a processor allowing a user to request the computer server to generate one or more user requested random numbers between 1 and 10 based a probably of 1 through 9 being 1 out of 13 and a probability of a 10 being 4 out of 13, additional random numbers, generated one at a time, until a sum of the value of first random number and each value of one or more additional random numbers exceeds 11. The computer server generates additional sequential random numbers, one at a time, while said second random number or a sum of values of said second random number and values of said sequential random number(s) are (i) less than a predetermined number, (ii) greater than the sum of the value of first random number and value of each additional random number request by the user, or (iii) greater than 11.

8 Claims, 1 Drawing Sheet

(56) References Cited

U.S. PATENT DOCUMENTS

| | | | | |
|---|---|---|---|---|
| 2002/0190468 | A1* | 12/2002 | Tchilinguirian | A63F 3/00157 273/292 |
| 2006/0030386 | A1* | 2/2006 | Rosemberg | A63F 3/00157 463/13 |
| 2006/0214372 | A1* | 9/2006 | Picken | A63F 3/00157 273/292 |
| 2007/0135193 | A1* | 6/2007 | Nicely | A63F 1/00 463/11 |

OTHER PUBLICATIONS

"Easy Jack". Jul. 1, 2017. < https://wizardofodds.com/games/easy-jack/> (Year: 2017).*

Easy Jack document, accessed and printed on Jan. 28, 2019 from https://easyjack.com/.

Las Vegas Sun document which has a publication date of Aug. 10, 2017 and which was accessed and printed on Jan. 18, 2019 from https://vegasinc.lasvepassun.com/business/gaming/2017/aup/10/students-new-las-vegas-table-game-similar-to-black/.

* cited by examiner

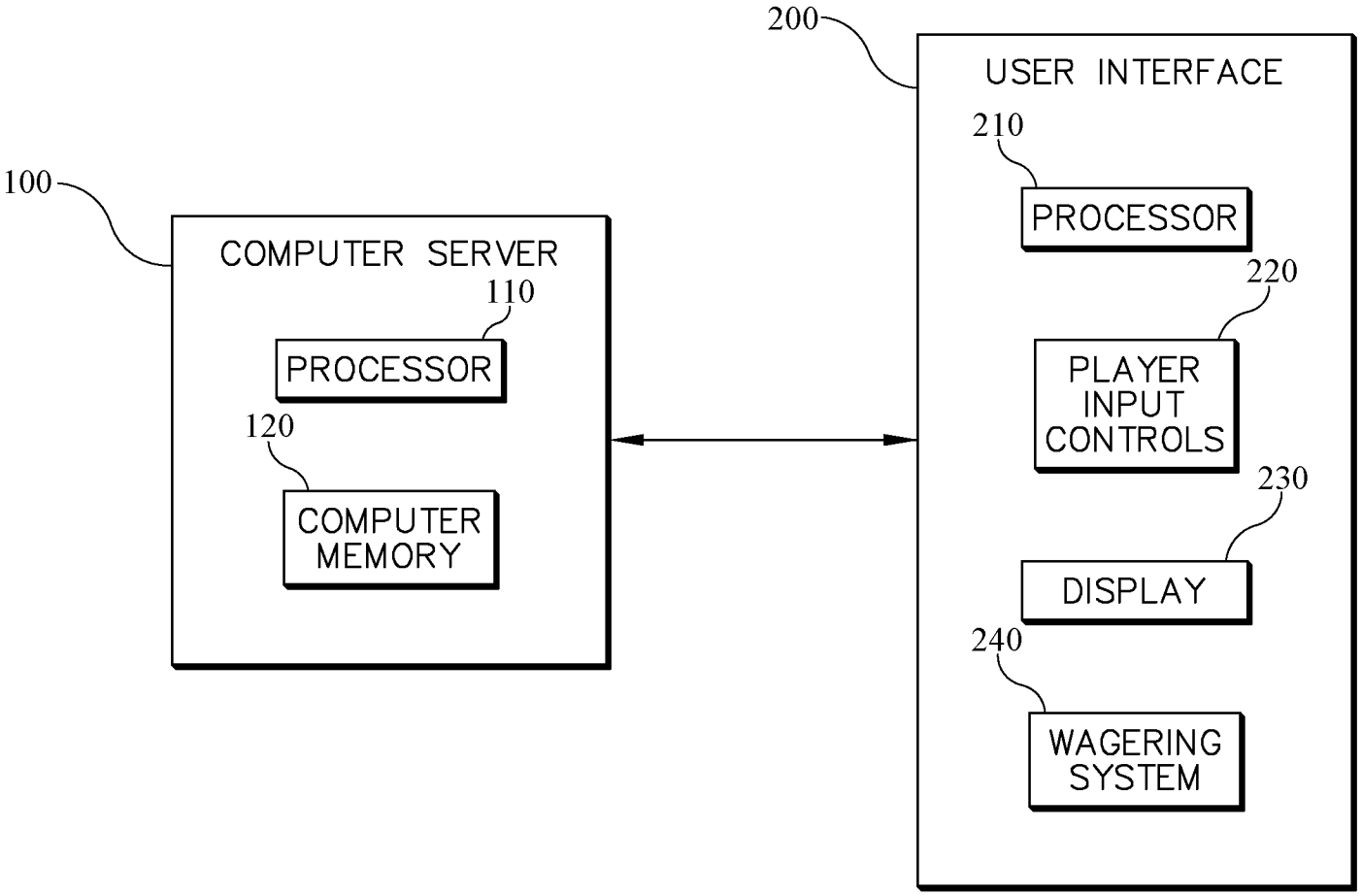
USER INTERFACE
PROCESSOR
210
PLAYER INPUT CONTROLS
220
DISPLAY
230
WAGERING SYSTEM
240
200
COMPUTER SERVER
PROCESSOR
110
COMPUTER MEMORY
120
100

ELECTRONIC GAME

CROSS-REFERENCE TO RELATED APPLICATION

This claims the benefit to U.S. provisional patent application Ser. No. 62/393,320, filed on Sep. 12, 2016, herein incorporated by reference.

FIELD OF THE INVENTION

The invention generally relates to a system and method for playing a high tempo game, including an electronic game system with user interface and processor facilitated outcome, advantageously achieving a high level of player interaction, excitement and game efficiency.

BACKGROUND OF THE INVENTION

Games are a diversion from everyday life. For centuries, humans have developed games to stimulate the mind, educate and entertain. Games include puzzles, board games and card games. An example of a card game is "Blackjack" or "21" is a popular casino game offered by gambling establishments. Typically, in Blackjack, each player wagers a bet and is dealt two cards by a dealer who also deals two cards to himself. To win, the player's cards must have a cumulative total card(s) value higher than that of the dealer, but no greater than twenty-one. One problem associated with the typical casino Blackjack game is that the game itself is relatively slow to develop since the dealer may have to deal two initial cards to many Players not including the dealer. Furthermore, each Player has to make the individual decision whether to "hit" or "stand" on their own card hand. This is especially time consuming when the player is indecisive. Accordingly, the pace is not fast enough and may reduce the potential revenue for the gambling establishment and individual customers. Moreover, some potential Players may be intimidated from playing the game because they fear being embarrassed by not adding fast enough or by adding their cards incorrectly in which they may inappropriately draw another card.

SUMMARY OF THE INVENTION

In view of aforementioned need, it is an object, in accordance with one aspect of the present invention, to provide a system for playing a game that includes a computer server having a processor configured to generate a plurality of random numbers, each random number being between 2 and 11 based a probably of 2 through 9 and 11 being 1 out of 13 and a probability of a 10 being 4 out of 13, each number 2 through 11 have a value corresponding to its number, respectively. The server generates at least a first random number and a second random number. A user interface is operatively associated with the computer server. The user interface has a processor allowing a user to request the computer server to generate one or more user requested random numbers between 1 and 10 based a probably of 1 through 9 being 1 out of 13 and a probability of a 10 being 4 out of 13, additional random numbers, generated one at a time, until a sum of the value of first random number and each value of one or more additional random numbers exceeds 11. The computer server generates additional sequential random numbers, one at a time, while said second random number or a sum of values of said second random number and values of said sequential random number(s) are (i) less than a predetermined number, (ii) greater than the sum of the value of first random number and value of each additional random number request by the user, or (iii) greater than 11.

In an alternative form, the present invention can be implemented as a card game such as a casino game used in professional casinos worldwide and gaming in general. In a casino embodiment, the invention can be played in conjunction with a conventional Blackjack casino-type table and a single or multiple standard deck(s) of 52 playing cards. The table surface not only has the main bet area, but also an extra bet area for an optional bonus wager. In such an embodiment, the table also displays a payoff scale on the bonus wager. As used herein, the term "card" is used in the present application to indicate a playing card of any facsimile thereof. For example, a card can be a paper playing card or an image of a card on a video display. Any representation of a card is contemplated.

The term "card game" is intended to include conventional table/board type games wherein one or more persons deal actual playing cards to one or more players, as well as any type of mechanical or electronic device which displays indicia of playing cards. Thus, the card game may be played as a live table card game, a video card game, or other computer format card game (e.g., over the Internet).

The goal of the present card game is to obtain a card hand of one or more cards with a cumulative total card(s) value of eleven. The values of the cards in a standard deck of cards are as follows: an ace has a value of "11" if it is the first card dealt and a value of "1" if it is the second or subsequence card dealt, cards "2" through "9" have a corresponding value of two through nine, and "10" and face cards have a corresponding value of "10". The values of the cards in a hand are added together. Players have options to draw one or more card as long as not to go over 11. However, Dealer is required to draw or stand pursuant to applicable rules. If the cumulative total card(s) value results in a number of "12" or higher, it is a losing hand similar to Blackjack that go over 21. As can be appreciated, the game, according to the present invention, is fast in that the dealer need not deal two initial cards to each player and it takes less cards to reach "11" than "2".

One feature of the present method is a game unlike prior games including blackjack which increases potential revenue to individual customer and the casinos by increasing the pace of the game.

Yet another object, in accordance with another aspect of the present invention, is to provide a method of playing a game which increase potential revenue to individual customer and the casinos by providing side wager during the normal course of play.

The present invention also provides a side-wager or bonus bet where player is awarded a predetermined amount when the player is betting that he or she will achieve a cumulative total card(s) value of "11" with one or 2 cards. Where these conditions are not met, the player loses the side wager.

The invention described herein is for illustrative purposes and therefore, various equivalent modifications can be made without departing from the spirit and scope of the invention, as will be recognized by those skilled in the relevant art. The teachings provided herein of the invention can be applied to other systems for playing card games, not necessarily the gaming method generally described above. The illustrated methods can omit some acts, can add other acts, and can execute the acts in a different order than that illustrated to achieve the advantages of the invention. At the option of the casino, the amount of the winning wager payout can be increased or decreased. This will have an affect on the amount of the house percentage advantage. Higher payouts would decrease the house percentage, while lower payouts would increase the house percentage. Such modifications should be considered within the scope of the invention.

BRIEF DESCRIPTION OF THE SOLE DRAWING

The sole FIGURE schematically illustrates an exemplary electronic game system of the present invention.

DESCRIPTION OF THE INVENTION

Referring now to the FIGURE, one exemplary electronic game system of the present invention includes a computer server 100 including a processor 110 configured to generate a plurality of random numbers, each random number being between 2 and 11 based a probably of 2 through 9 and 11 being 1 out of 13 and a probability of a 10 being 4 out of 13, each number 2 through 11 have a value corresponding to its number, respectively, such that the random numbers correspond to cards in a standard deck of card, and computer memory 120 storing each said random number generated by said computer server 100. The system further includes a user interface 200 operatively associated with the computer server 100 which includes a user interface processor 210. Player input controls 220 allow a user to request said computer server 100 to generate one or more user requested random numbers between 1 and 10 based a probably of 1 through 9 being 1 out of 13 and a probability of a 10 being 4 out of 13, each number 1 through 10 have a value corresponding to its number, respectively. A display 230 associated with the user interface 200 displays card indicia corresponding to each random number generated. A wagering system 240 accepts wagers from a user.

The goal of the present game implemented using playing cards, is for a player to obtain a card hand having a cumulative total card(s) value of "11" or a cumulative total card(s) value closer to "11" than the cumulative total card(s) value of the dealer's hand. The card value is based upon a card valuing schedule as follows:

| Card | Value |
|---|---|
| Ace | 11 (first dealt card)<br>1 (second or subsequently dealt card(s) |
| 10, J, Q, K | 10 |
| 9 | 9 |
| 8 | 8 |
| 7 | 7 |
| 6 | 6 |
| 5 | 5 |
| 4 | 4 |
| 3 | 3 |
| 2 | 2 |

Both the dealer and player initially receive one card with the dealer's card face down position and players' card being in a revealed, i.e. face up position. If the player does not initially have an Ace or "11" card value, extra card(s) may be drawn in order to either reach a cumulative total card(s) value of "11" or approach a cumulative total card(s) value "11" as close as possible. Once the player reaches a desired cumulative total card(s) value, the player "stands". When the cumulative total card(s) value of the player's hand is greater than "11", the game terminates for the player, thereby resulting in the player losing the main wager. When all of the players have completed their play, the dealer then reveals his down card and tries to beat the player's cumulative total card(s) value. House rules normally require the dealer, having a cumulative total card(s) value less than "6," to take another card or "hit". If the dealer's cumulative total card(s) value is "6" or higher, the dealer cannot take anymore cards, i.e. the dealer must "stand". It will be appreciated, however, that house rules normally require the dealer to draw or stand can be changed without departing from the true spirit and nature of the present invention, Meanwhile, the dealer takes additional cards to achieve a desired cumulative total card(s) value less than or equal to a value of "11" and greater than the cumulative total card(s) value of the player's cards. The arrangement is such that the main wager and a predetermined amount (e.g. an amount equal to the main wager) is awarded to the player if the player has a higher cumulative total card(s) value than the dealer, or the main wager is awarded to the dealer if the dealer has a cumulative total card(s) value higher than the player. Ties in the card(s) count are denoted as a "push" with no money changing hands. The rankings of the hands (cumulative total card(s) value) from highest to lowest are as follow: "A", 11, 10, 9, 8, 7, 6, 5, 4, 3, 2. With the side bet of the present invention, the player is given the opportunity to place an optional bonus bet on the player's hand before any card is dealt. The player is awarded a predetermined amount when the player first dealt card has a value of "11" (i.e., an ace). The player is also awarded a different predetermined amount when the first two cards dealt achieve a cumulative total card(s) value of "11" either of the same or mixed suits. Where these conditions are not met, the player loses the side wager.

Examples of pay tables for the bonus wager are shown below:

| Player's Hand | Payout Odds |
|---|---|
| First card dealt to player is "Ace" | 10 To 1 |

As would be apparent to one skilled in the relevant art, alternative payoff scales can be practiced with the invention.

It will be understood that various details of the presently disclosed subject matter can be changed without departing from the scope of the subject matter disclosed herein. Furthermore, the foregoing description is for the purpose of illustration only, and not for the purpose of limitation.

The invention claimed is:

1. A system for enabling a wagering game comprising:

a computer server including:

a processor configured to generate a plurality of random numbers, each random number being between 2 and 11 based a probably of 2 through 9 and 11 being 1 out of 13 and a probability of a 10 being 4 out of 13, each number 2 through 11 have a value corresponding to its number, respectively, such that the random numbers correspond to cards in a standard deck of cards, and computer memory storing each said random number generated by said computer server;

a user interface operatively associated with the computer server, said user interface including:

a user interface processor, player input controls allowing a user to request said computer server to generate one or more user requested random numbers between 1 and 10 based a probably of 1 through 9 being 1 out of 13 and a probability of a 10 being 4 out of 13, each number 1 through 10 have a value corresponding to its number, respectively, a display associated with the user interface for displaying card indicia corresponding to said random numbers generated, and a wagering system that accepts wagers from a user;

wherein, the system enables a method in memory of the wagering game comprising steps of:

placing a main wager by each player to participate in the game;

dealing a first card to each player to define an initial one-card player's hand;

dealing a first card to the dealer defining an initial one-card dealer's hand;

giving each player a chance to examine said first card received by that player and to stand on the value of said initial one-card player's hand or taking additional card (s) until the player achieves a desired cumulative total card(s) value less than or equal to a predetermined numerical value, the game terminating when said cumulative total card(s) value is greater than said predetermined numerical value thereby resulting in said player losing said main wager;

the dealer either standing on said dealer's initial one-card dealer's hand or sequentially taking additional cards if allowed by a pre-established procedure to achieve a cumulative total card(s) value less than or equal to said predetermined numerical value; and awarding either the player or dealer a win by comparing said player's cumulative total card(s) value with said dealer's cumulative total card(s) value.

2. The system as recited in claim 1, wherein awarding the player a win if said player's cumulative total card(s) value is higher than said dealer's cumulative total card(s) value.

3. The system as recited in claim 1, wherein awarding the dealer a win if said dealer's cumulative total card(s) value is higher than said player's cumulative total card(s) value.

4. The system as recited in claim 1, wherein if said player's and dealer's cumulative total card(s) value are the same, it is a tie and the player neither wins nor loses.

5. The system as recited in claim 1, wherein said first card dealt to the dealer is not visible to the player.

6. The system as recited in claim 1, wherein the dealer must stand on said first card being six or higher or said cumulative total card(s) value is six or higher.

7. The system as recited in claim 1, wherein the dealer must draw additional card when said dealer's first card or said cumulative total card(s) value is five or lower.

8. The system as recited in claim 1, wherein said predetermined numerical value is eleven.

* * * * *